US007987832B2

(12) United States Patent
Lin

(10) Patent No.: US 7,987,832 B2
(45) Date of Patent: Aug. 2, 2011

(54) LUBRICATION SYSTEM FOR AN ENGINE

(76) Inventor: Szu Liang Lin, Taichung (TW)

( * ) Notice: Subject to any disclaimer, the term of this patent is extended or adjusted under 35 U.S.C. 154(b) by 527 days.

(21) Appl. No.: 12/171,300

(22) Filed: Jul. 11, 2008

(65) Prior Publication Data

US 2009/0013959 A1 Jan. 15, 2009

(30) Foreign Application Priority Data

Jul. 17, 2007 (TW) ..... 96125988 A

(51) Int. Cl.

| | |
|---|---|
| ***F01M 1/02*** | (2006.01) |
| ***F01M 9/10*** | (2006.01) |
| ***F01M 1/00*** | (2006.01) |
| ***F01M 11/02*** | (2006.01) |
| ***F01M 1/04*** | (2006.01) |
| ***F02B 25/06*** | (2006.01) |

(52) U.S. Cl. ..... 123/196 R; 123/572; 184/6.5; 184/6.26

(58) Field of Classification Search ..... 123/196 R
See application file for complete search history.

(56) References Cited

U.S. PATENT DOCUMENTS

| | | | | |
|---|---|---|---|---|
| 5,924,400 | A * | 7/1999 | Kobayashi | 123/196 R |
| 6,202,613 | B1 * | 3/2001 | Nagai | 123/90.34 |
| 6,213,079 | B1 * | 4/2001 | Watanabe | 123/196 R |
| 6,394,061 | B2 * | 5/2002 | Ryu et al. | 123/196 R |
| 6,769,391 | B1 * | 8/2004 | Lee et al. | 123/196 R |
| 7,243,632 | B2 * | 7/2007 | Hu | 123/196 R |
| 7,287,508 | B2 * | 10/2007 | Kurihara | 123/196 R |

* cited by examiner

*Primary Examiner* — Nathan J Newhouse
*Assistant Examiner* — Grant Moubry

(57) ABSTRACT

A lubrication system for a small lightweight four-stroke engine is disclosed. The lubrication system, provided with a weight at one end of a flexible oil tube inserted into an oil reservoir, is capable of providing a sufficient lubrication to components of the engine which may operate in a horizontal posture, a vertical posture, or any posture therebetween.

1 Claim, 10 Drawing Sheets

LUBRICATION SYSTEM FOR AN ENGINE

BACKGROUND OF THE INVENTION

1. Field of Invention

The invention relates to a four-stroke internal combustion engine (ICE) and more particularly to an improved lubrication system for a small lightweight four-stroke engine.

2. Description of Related Art

Portable power tools such as lawn movers, line trimmers, chain saws were mostly powered by two-stroke ICEs in earlier days. Gradually, two-stroke engines were phased out due to heavy harmful exhaust emissions (e.g., hydrocarbon (HC)). Nowadays, almost all such portable power tools are powered by four-stroke ICEs.

Lubrication becomes a very serious problem since portable power tools are required to operate in a wide range of orientations (i.e., being tilted or even upside down). There have been numerous suggestions in prior patents for solving this problem. For example, U.S. Pat. No. 7,287,508 discloses an engine lubrication method which is incorporated herein by reference. Thus, continuing improvements in the exploitation of lubrication system for a small lightweight four-stroke engine are constantly being sought.

SUMMARY OF THE INVENTION

It is therefore one object of the invention to provide a lubrication system for a small lightweight four-stroke engine and the lubrication system, provided with a weight at one end of a flexible oil tube inserted into an oil reservoir, is capable of providing a sufficient lubrication to the engine which may operate in a horizontal posture, a vertical posture, or any posture therebetween.

The above and other objects, features and advantages of the invention will become apparent from the following detailed description taken with the accompanying drawings.

DETAILED DESCRIPTION OF THE INVENTION

Figure 1:
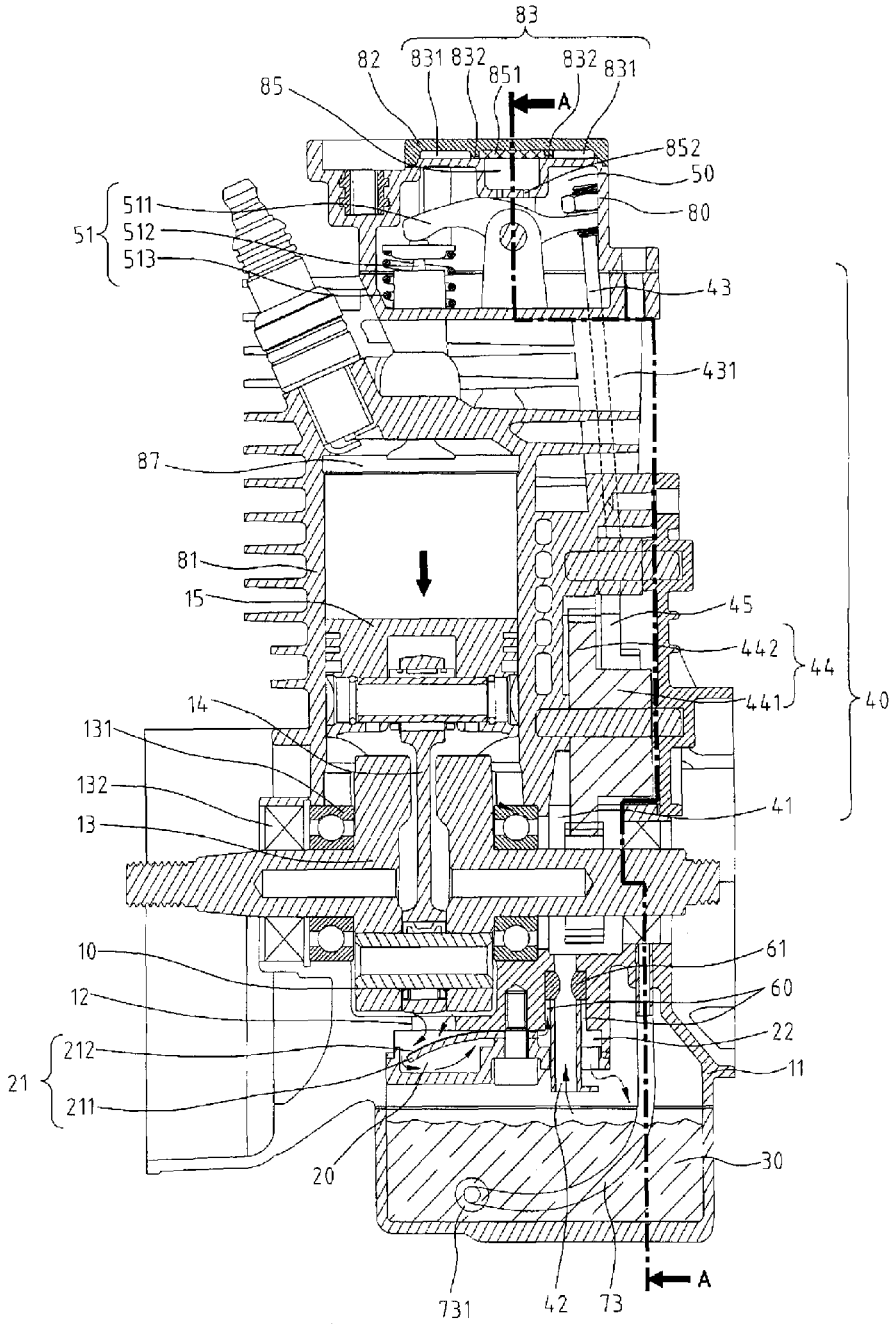
FIG. 1 is a longitudinal sectional view of a four-stroke engine incorporating a lubrication system according to an embodiment of the invention.
Figure 2:
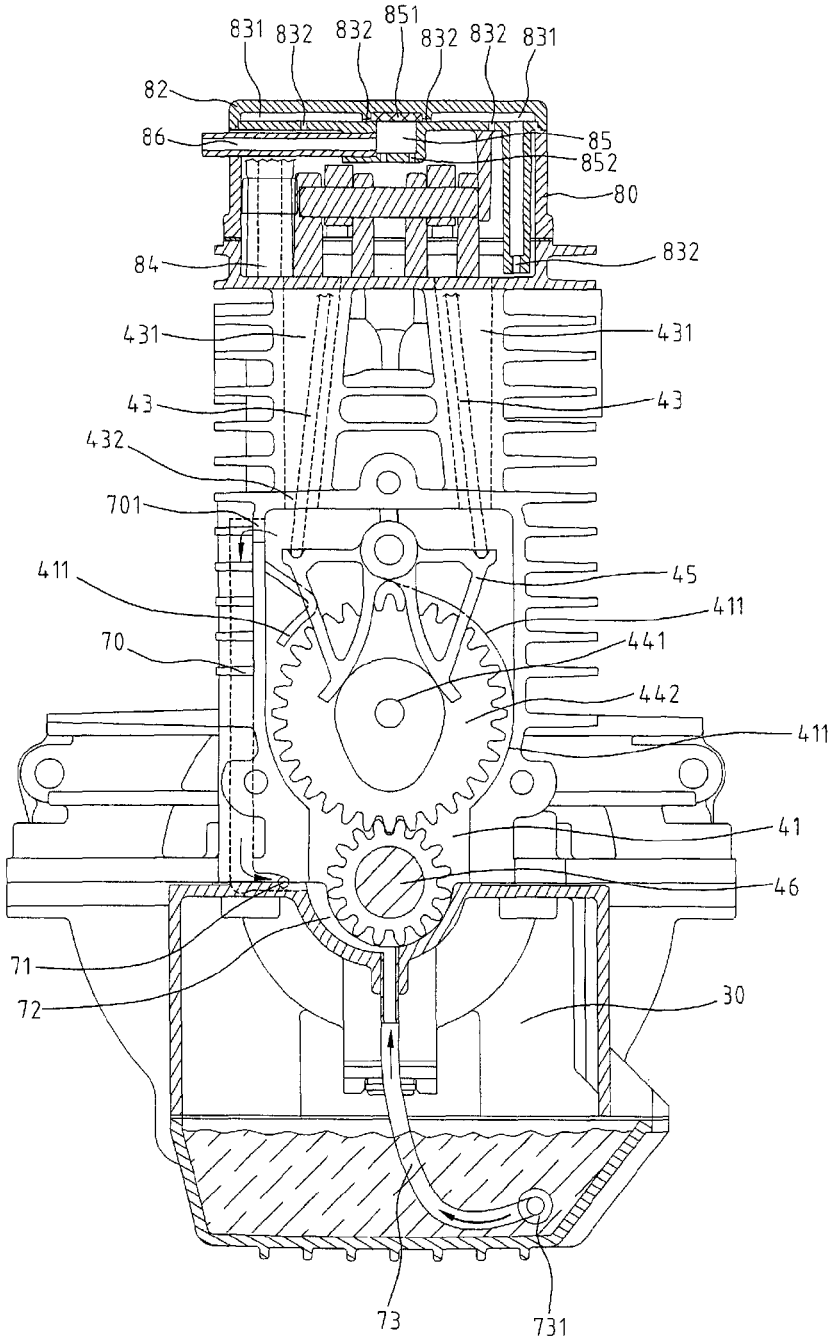
FIG. 2 is a sectional view taken along line A-A of FIG. 1.
Figure 3:
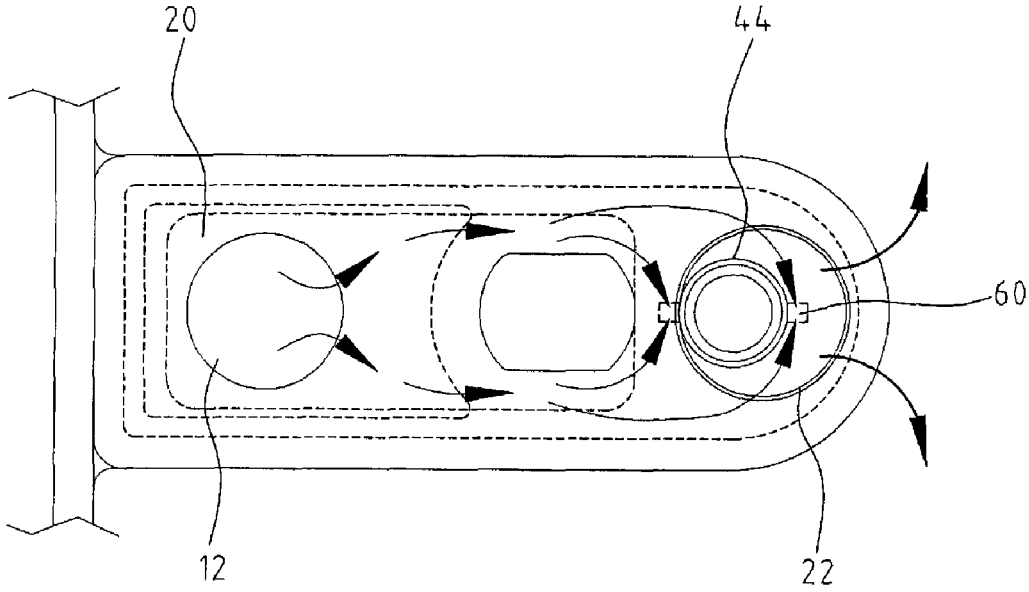
FIG. 3 schematically depicts the check valve case in FIG. 1.
Figure 4:
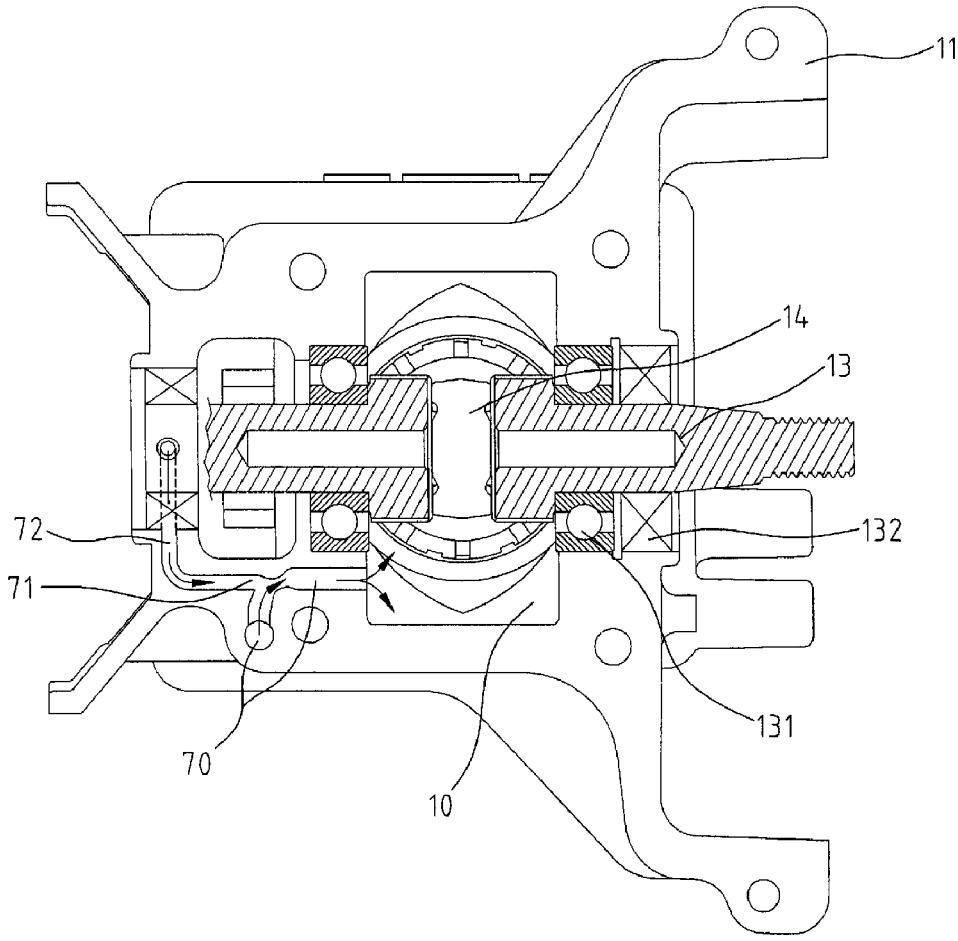
FIG. 4 shows lubricating oil flowing to the crankcase when the piston moves upward.
Figure 5:
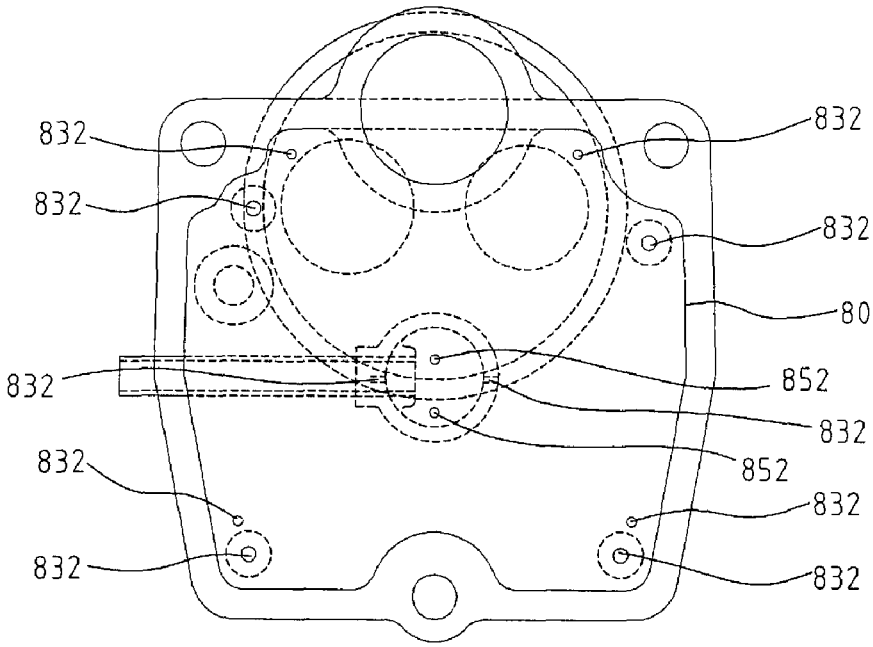
FIG. 5 schematically shows the oil return section.

Referring to FIGS. 1 to 10, a four-stroke internal combustion engine (ICE) in accordance with a preferred embodiment of the invention is shown. The engine is constructed as a lightweight housing and comprises the following components. Each component is discussed in detail below.

A crankcase 10 is provided. An oil reservoir 30 is provided. A check valve case 20 is provided in fluid communication with both the crankcase 10 and the oil reservoir 30. A first branch tube 60 is in fluid communication with both the check valve case 20 and a gaseous oil tube 42 which is connected to a cam actuation section 40. A first venturi 61 is provided proximate a joining portion of the cam actuation section 40 and the gaseous oil tube 42. Note that the number of the first venturi 61 may be more than one depending on applications. A second branch tube 70 is provided between the crankcase 10 and a camshaft case 41 of the cam actuation section 40 and is in fluid communication therewith. A second venturi 71 is provided in the second branch tube 70. The second branch tube 70 has a flexible oil tube 73 having a weight 731 at one end so that one end of the flexible oil tube 73 may be always immersed in the oil reservoir 30, and a tubing member 72 connected to the flexible oil tube 73 and being in fluid communication therewith.

The crankcase 10 comprises a crank casing 11 formed with a cylinder block 81 which has a cylinder bore (not numbered) with a piston 15 slidably provided therein. A passage 12 is provided on the bottom of the crankcase 10 and is in fluid communication with the check valve case 20. A crankshaft 13, provided in the crankcase 10, has two sets of bearings 131 and oil seals 132 at both ends. A connecting rod 14 is provided to interconnect the crankshaft 13 and the piston 15.

The check valve case 20 is provided below the crankcase 10. The check valve case 20 is connected to an oil mist return tube 22 which is extended from the bottom of the check valve case 20 into the oil reservoir 30. A check valve 21 is provided in the check valve case 20 and has a retaining plate 211 and an elastic plate 212 being on the top surface of the retaining plate 211. Oil mist from the crankcase 10 may deflect the elastic plate 212 to open the check valve 21 when the piston 15 moves downward. Hence, oil mist enters the check valve case 20. Finally, oil mist flows to the oil reservoir 30 via the oil mist return tube 22. At the same time, a small portion of oil mist enters the first branch tube 60 which is in fluid communication with the check valve case 20 (see FIG. 3). To the contrary, the elastic plate 212 returns to its original position to block the check valve 21 when the piston 15 moves upward. Hence, oil mist is prevented from returning from the oil reservoir 30 to the crankcase 10.

The oil reservoir 30 is provided below the check valve case 20 and is in fluid communication with the check valve case 20 via the oil mist return tube 22. Liquid lubricating oil is filled in the oil reservoir 30. The oil reservoir 30 has a volume larger than that of the check valve case 20. Hence, flow rate of the oil mist may decrease greatly when it enter the oil reservoir 30. As a result, heavy liquid oil particles in the oil mist fall into the oil reservoir 30 and light gaseous oil particles in the oil mist are accumulated on the oil level of the oil reservoir 30. Further, gaseous oil may enter the gaseous oil tube 42. An open end of the oil mist return tube 22 is provided above the center of the oil reservoir 30.

The cam actuation section 40 comprises a lower camshaft case 41 and an upper space 431. Two spaced ports 432 are provided between the camshaft case 41 and the space 431. A pushing rod 43 passes through either port 432. In addition to the pushing rods 43, a camshaft 44 and a camshaft follower 45 are provided in the cam actuation section 40. The camshaft 44 comprises a cam 441 and a reduction gear 442 coaxially and integrally formed therewith. The camshaft 44 and the camshaft follower 45 are engaged. The reduction gear 442 is in mesh with a lower gear 46 which is fixed in the crankshaft 13. The cam actuation section 40 has a top end in fluid communication with a rocker arm case 50 and a bottom end provided with the gaseous oil tube 42. The gaseous oil tube 42 has a bottom end disposed above the oil level of the oil reservoir 30. Gaseous oil rather than liquid oil in the oil reservoir 30 may flow to the cam actuation section 40 via the gaseous oil tube 42 when the piston 15 moves downward. Oil mist in the camshaft case 41 is directed along an inner wall 411 of the camshaft case 41 to the ports 432 and a second branch tube inlet 701 when the reduction gear 442 rotates.

The engine may be implemented as an overhead valve (OHV) engine in the embodiment. Alternatively, the engine may be implemented as an overhead camshaft (OHC) engine equipped with a cam 443, upper and lower pulleys 444 in which one of the pulleys 444 is secured to the cam 443, and a belt 47 passing around the pulleys 444 in another embodiment (see FIG. 10).

The rocker arm case 50 is provided in a plastic cylinder head cover 80 which is affixed to the cylinder block 81. In the rocker arm case 50 a rocker arm mechanism 51 is provided. The rocker arm mechanism 51 comprises a rocker arm 511, a valve 512, and a compression spring 513. The cam 441 may rotate to actuate the rocker arm mechanism 51 via the camshaft follower 45 and the pushing rods 43.

A small portion of oil mist in the check valve case 20 enters the first venturi 61 via the first branch tube 60. Liquid oil particles in the oil mist are nebulized by the first venturi 61. As an end, oil mist with a small amount of liquid oil enters the camshaft case 41.

The second branch tube 70 has a second branch tube inlet 701 provided in the camshaft case 41 near the port 432. Excess oil mist in the cam actuation section 40 may enter the crankcase 10 via the second branch tube 70 when the piston 15 moves upward. As a result, excess oil mist and liquid oil are prevented from remaining in the cam actuation section 40 and the rocker arm case 50. This has the benefit of reducing the consumption of lubricating oil.

The number of the second branch tube 70 may be more than one depending on applications. Excess oil mist enters the second branch tube 70 when the piston 15 moves upward. Also, lubricating oil in the oil reservoir 30 flows to the second branch tube 70 via the flexible oil tube 73 and the tubing member 72. Oil mist in the second branch tube 70 and liquid oil in the tubing member 72 are mixed in the second venturi 71. Further, the nebulized oil mist enters the crankcase 10 when the piston 15 moves upward.

An oil return section 83 is provided on the top of the cylinder head cover 80 and is separated from the rocker arm case 50 therebelow. The oil return section 83 comprises two oil return reservoirs 831 being in fluid communication with each other, and a plurality of channels 832 interconnecting the oil return section 83 and the rocker arm case 50. Excess oil mist and liquid oil may enter at least one of the channels 832 irrespective of the posture of the engine (i.e., horizontal posture, vertical posture, or any posture therebetween). Therefore, the purpose of returning lubricating oil in the rocker arm case 50 can be achieved.

One end of the oil return section 83 is provided with an oil return line 84 which has one end in fluid communication with the crankcase 10 so that the oil return section 83 can communicate with the crankcase 10. Excess oil mist and liquid oil in the rocker arm case 50 may return to the oil return section 83 via the channels 832. Next, the excess oil mist and liquid oil are inhaled into the crankcase 10 via the oil return line 84.

A liquid oil and gaseous oil separation chamber 85 is provided between the oil return section 83 and the rocker arm case 50. A porous plate 851 for absorbing lubricating oil is provided on the top of the liquid oil and gaseous oil separation chamber 85. A plurality of apertures 852 are provided on the bottom of the liquid oil and gaseous oil separation chamber 85 and are in fluid communication with the rocker arm case 50. Thus, excess oil mist may enter the liquid oil and gaseous oil separation chamber 85 via the apertures 852. Liquid oil particles in the oil mist are absorbed by the porous plate 851. Next, the absorbed liquid oil is inhaled into the oil return section 83 via the channels 832. Finally, it is sent to the crankcase 10 via the oil return line 84. Gaseous oil is separated by the liquid oil and gaseous oil separation chamber 85 to form blow-by gas which is sent to an air filter (not shown) via a breather pipe 86. Blowby gas with clean air passing through the air filter is inhaled into a combustion chamber 87 in an air intake cycle of the engine (see FIG. 1). Finally, the blowby gas and clean air are consumed in the combustion cycle of the engine.

Figure 6:
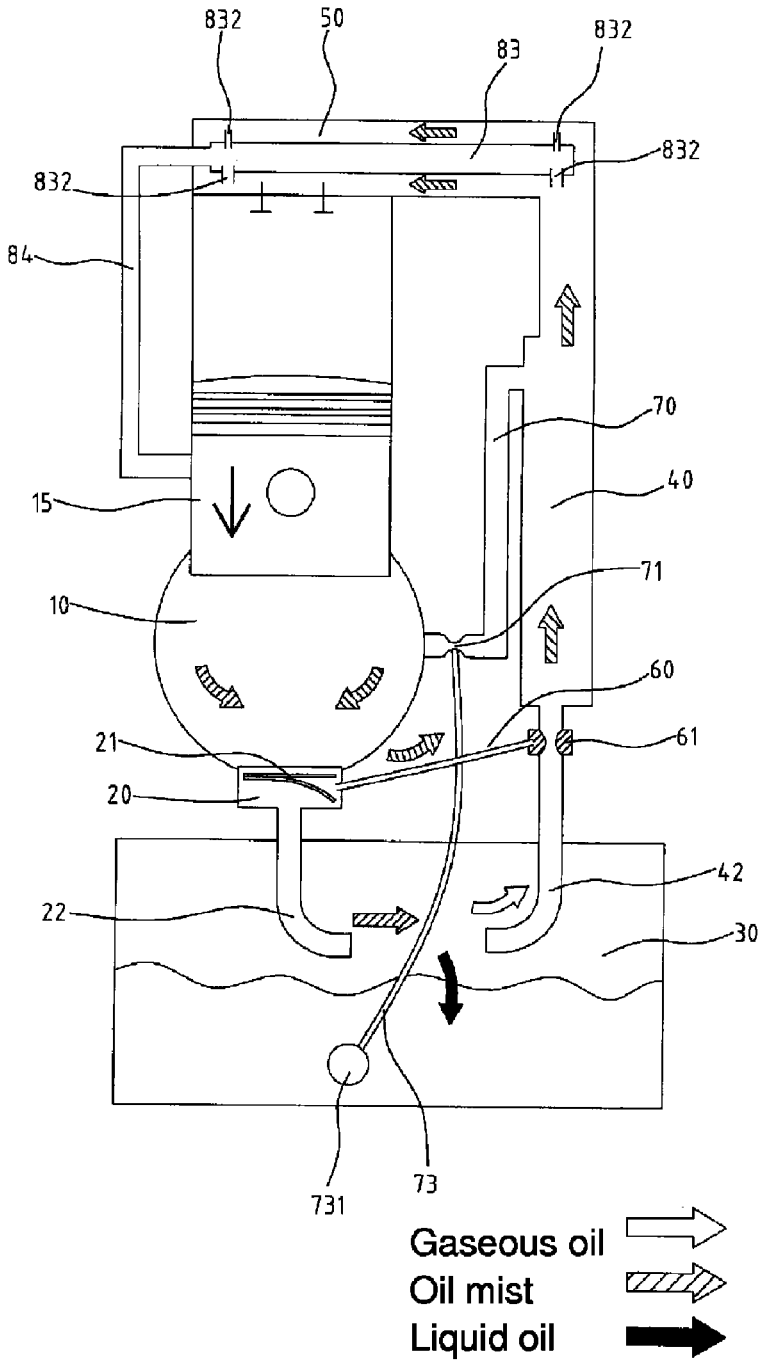
FIG. 6 schematically depicts the path of lubricating oil flow when the piston moves downward.

As shown FIG. 6, volume of the crankcase 10 is decreased when the piston 15 moves downward. And in turn, oil mist in the crankcase 10 enters the check valve case 20. Diameter of the oil mist return tube 22 is much larger than that of the first branch tube 60. Hence, a large portion of oil mist flows toward the oil reservoir 30 via the oil mist return tube 22 and only a small portion thereof flows to the first branch tube 60. Liquid oil in the oil mist is formed after leaving the oil mist return tube 22 since the flow speed of the oil mist in the oil reservoir 30 decreases greatly. Hence, the heavy liquid oil drops into the oil reservoir 30. Also, light gaseous oil is accumulated on the oil level of the oil reservoir 30 and is sent to the gaseous oil tube 42. Also, oil mist may branch from the check valve case 20 to flow to the first venturi 61 via the first branch tube 60. Oil mist is then mixed with gaseous oil sent from the gaseous oil tube 42 at the first venturi 61. The nebulized lubricating oil mixture is sent to the cam actuation section 40 and the rocker arm case 50 in sequence for lubrication.

Figure 7:
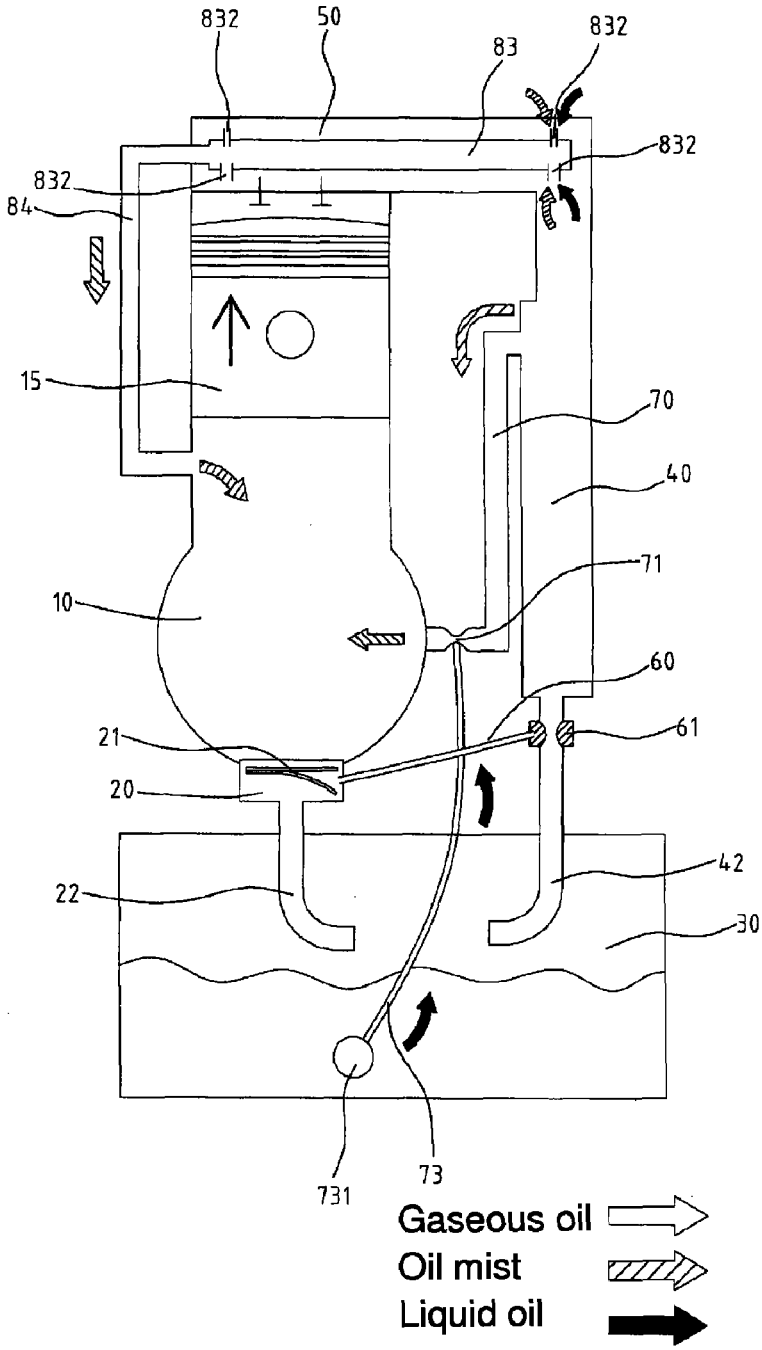
FIG. 7 schematically depicts the path of lubricating oil flow when the piston moves upward.
Figure 8:
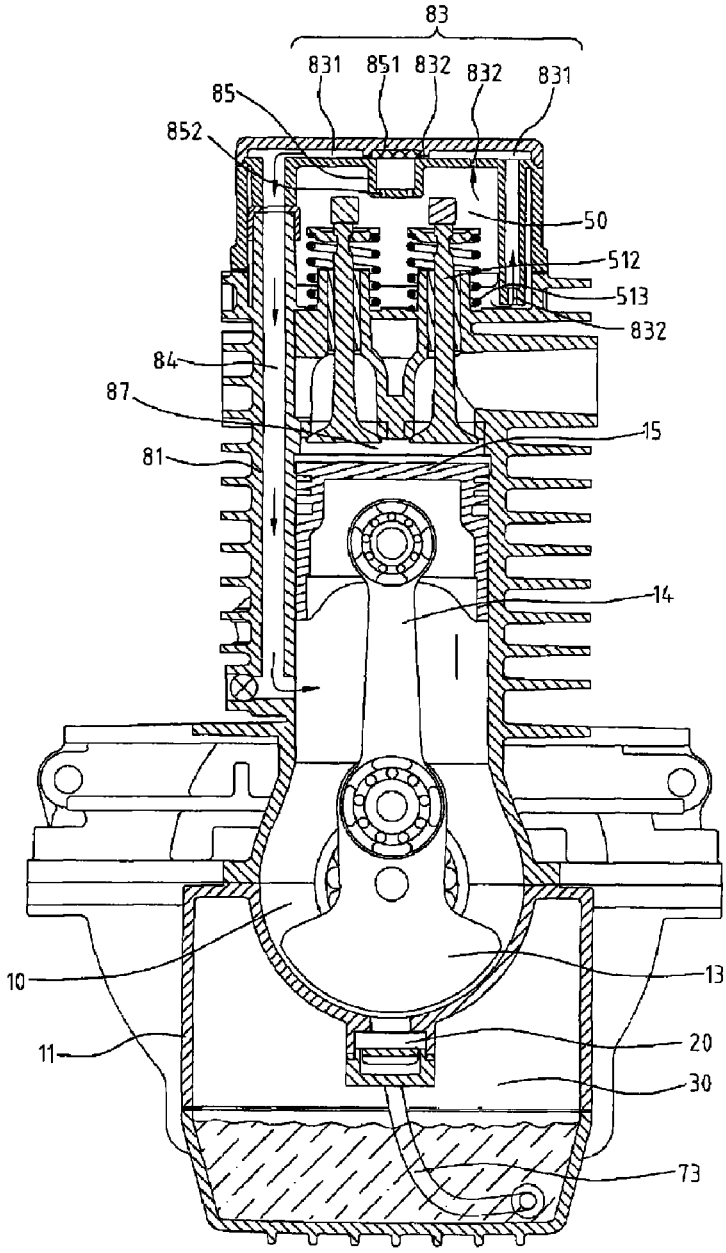
FIG. 8 schematically depicts the path of lubricating oil flow when the piston moves upward when the engine is disposed upright.
Figure 9:
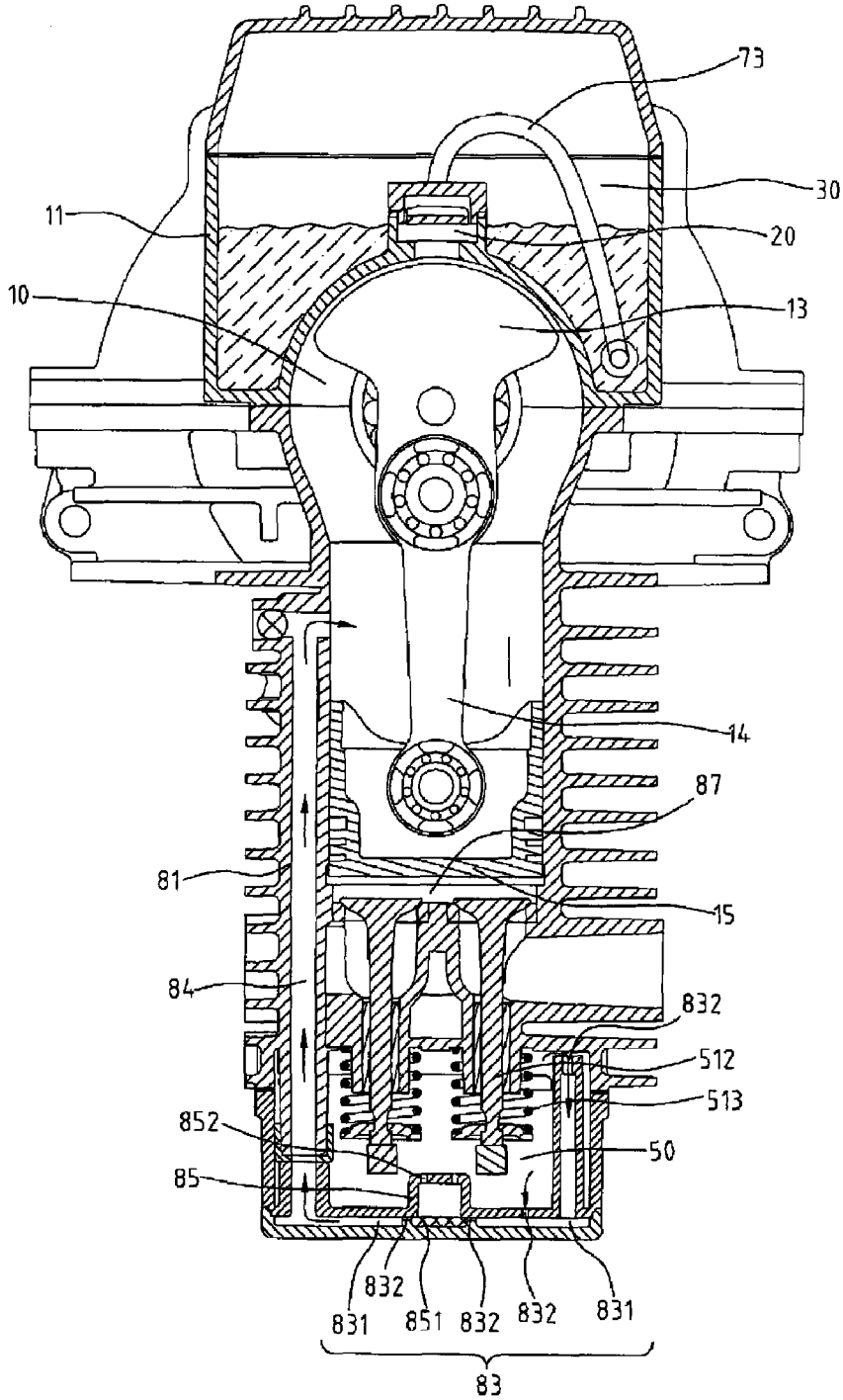
FIG. 9 schematically depicts the path of lubricating oil flow when the piston moves upward when the engine is disposed upside down.
Figure 10:
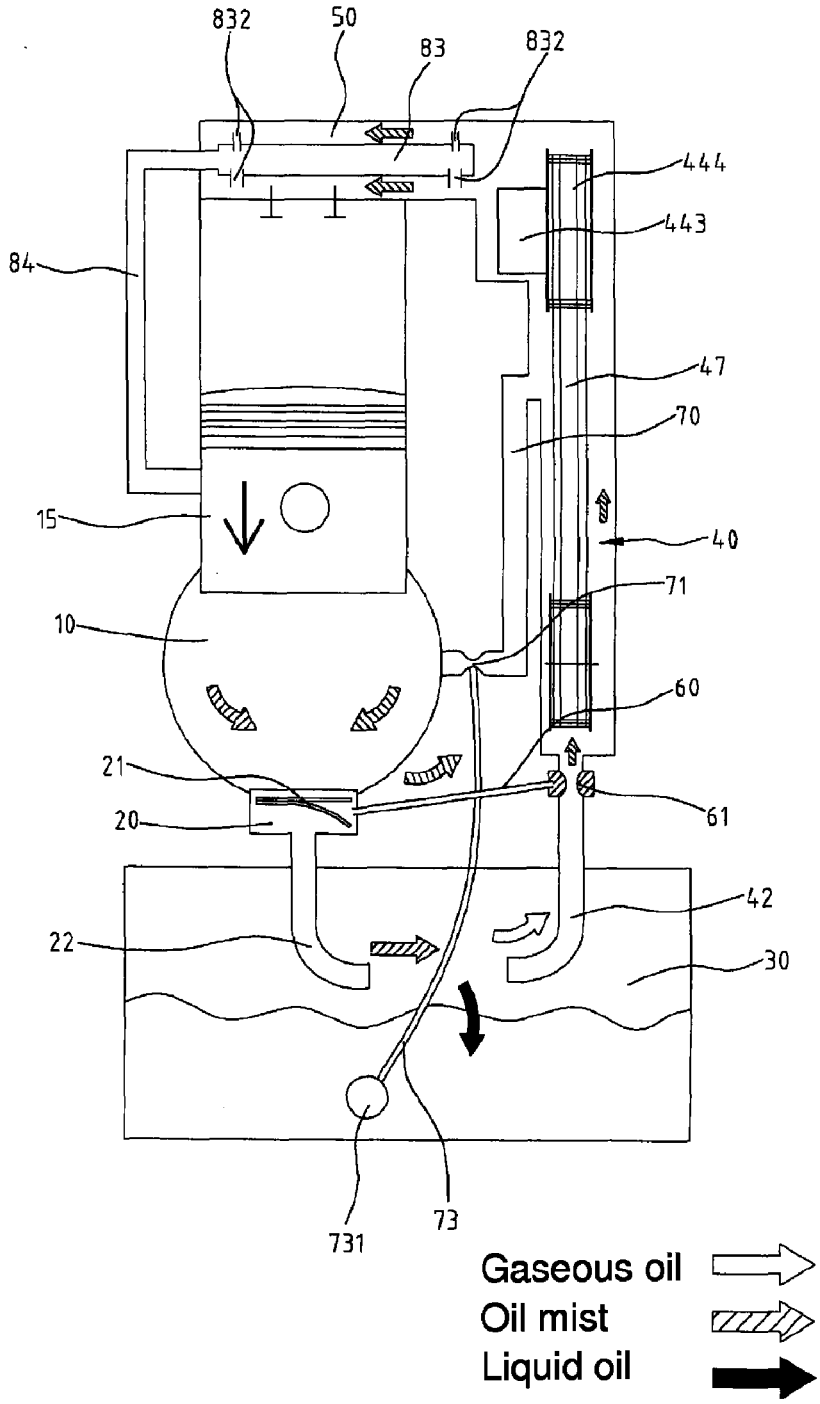
FIG. 10 schematically depicts the path of lubricating oil flow when the piston moves downward with an overhead camshaft being mounted in the engine according to another embodiment of the invention.

As shown in FIGS. 7, 8, and 9, volume of the crankcase 10 is increased when the piston 15 moves upward. And in turn, excess oil mist and liquid oil in the cam actuation section 40 are inhaled into the second branch tube 70. Also, lubricating oil in the oil reservoir 30 is sucked into the flexible oil tube 73. And in turn, lubricating oil flows to the second branch tube 70 via the tubing member 72 which is connected to the flexible oil tube 73. Lubricating oil is nebulized in the second venturi 71. The nebulized lubricating oil is then sent to the crankcase 10. At the same time, oil mist and liquid oil in the rocker arm case 50 may enter the oil return reservoirs 831 via the channels 832. All oil mist and liquid oil contained in the oil return section 83 will be inhaled into the oil return line 84 prior to entering the crankcase 10.

Oil mist and liquid oil in the crankcase 10 will flow to the check valve case 20 when the piston 15 moves downward.

While the invention herein disclosed has been described by means of specific embodiments, numerous modifications and variations could be made thereto by those skilled in the art without departing from the scope and spirit of the invention set forth in the claims.

What is claimed is:

1. A single-cylinder, four-stroke cycle, spark ignition internal combustion engine for mounting on a power tool comprising:

a cylinder (81);

a piston (15) slidably disposed in the cylinder (81);

a crankcase (10) disposed below the cylinder (81);

an oil reservoir (30) disposed below the crankcase (10);

a cam actuation section (40) comprising a lower camshaft case (41), an upper space (431), a plurality of pushing rods (43) in the upper space (431), a plurality of ports (432) disposed between the camshaft case (41) and the upper space (431) with the pushing rods (43) passing through, a camshaft (44) with a cam (441) and a reduction gear (442), a camshaft follower (45) engaged with the camshaft (44), a lower gear (46) secured to the crankshaft (13) and being in mesh with the reduction gear (442), and a gaseous oil tube (42) extending to a position above the oil level of the oil reservoir (30);

a rocker arm case (50) disposed above the cam actuation section (40) and being in fluid communication therewith, the rocker arm case (50) comprising a rocker arm (511) and a valve (512) on the top of the cylinder (81) wherein the rocker arm (511) is adapted to operate by actuating the camshaft follower (45) and the pushing rods (43) by rotating the cam (441);

a check valve case (20) disposed below the crankcase (10) and being in fluid communication with the crankcase (10) and the oil reservoir (30), the check valve case (20) having an oil mist return tube (22) extending into the oil reservoir (30), and a check valve (21);

a first branch tube (60) being in fluid communication with the check valve case (20) and the gaseous oil tube (42);

a first venturi (61) disposed in the gaseous oil tube (42) near a joining portion of the gaseous oil tube (42) and the first branch tube (60);

a second branch tube (70) interconnecting the crankcase (10) and the cam actuation section (40) and being in fluid communication therewith;

a second venturi (71) disposed in the second branch tube (70);

a flexible oil tube (73) having a weight (731) at one end immersed in the oil reservoir (30);

a tubing member (72) connected to the flexible oil tube (73);

a crankshaft (13) rotatably disposed in the crankcase (10);

a connecting rod (14) interconnecting the crankshaft (13) and the piston (15);

an oil return section (83) disposed on the top of the rocker arm case (50), the oil return section (83) comprising a plurality of oil return reservoirs (831) being in fluid communication with each other, and a plurality of channels (832) interconnecting the oil return section (83) and the rocker arm case (50);

an oil return line (84) interconnecting the oil return section (83) and the crankcase (10); and a liquid oil and gaseous oil separation chamber (85) disposed between the oil return section (83) and the rocker arm case (50), the liquid oil and gaseous oil separation chamber (85) being in fluid communication with the rocker arm case (50);

wherein irrespective of the posture of the internal combustion engine in response to moving the piston (15) in a first direction to decrease the volume of the crankcase (10), oil mist in the crankcase (10) enters the check valve case (20), a first portion of the oil mist flows to the oil reservoir (30) via the oil mist return tube (22), a second portion of the oil mist being smaller than the first portion thereof in volume flows to the first branch tube (60), liquid oil in the oil mist is formed after leaving the oil mist return tube (22) and drops into the oil reservoir (30), gaseous oil in the oil mist is accumulated above the oil level of the oil reservoir (30) and flows to the gaseous oil tube (42), the oil mist also branches from the check valve case (20) to flow to the first venturi (61) via the first branch tube (60), and the oil mist is mixed with the gaseous oil from the gaseous oil tube (42) at the first venturi (61) to form a nebulized mixture which is sent to the cam actuation section (40) and the rocker arm case (50) in sequence for lubrication; and wherein irrespective of the posture of the internal combustion engine in response to moving the piston (15) in a second direction to increase the volume of the crankcase (10), excess oil mist and liquid oil in the cam actuation section (40) are inhaled into the second branch tube (70), lubricating oil in the oil reservoir (30) is sucked into the flexible oil tube (73) and flows to the second branch tube (70) via the tubing member (72), the lubricating oil is nebulized in the second venturi (71) and flows to the crankcase (10), oil mist and liquid oil in the rocker arm case (50) enter the oil return section (83) via the channels (832), the oil mist and the liquid oil contained in the oil return section (83) are inhaled into the crankcase (10) via the oil return line (84), and the oil mist and the liquid oil in the oil return line (84) and the second branch tube (70) flow from the crankcase (10) to the check valve case (20) in response to moving the piston (15) moves in the first direction.

* * * * *